US011519222B1

(12) United States Patent
Hubschmitt

(10) Patent No.: US 11,519,222 B1
(45) Date of Patent: Dec. 6, 2022

(54) SCREEN RETENTION DEVICE AND METHOD OF USE

(71) Applicant: Christopher Lee Hubschmitt, Jupiter, FL (US)

(72) Inventor: Christopher Lee Hubschmitt, Jupiter, FL (US)

( * ) Notice: Subject to any disclaimer, the term of this patent is extended or adjusted under 35 U.S.C. 154(b) by 531 days.

(21) Appl. No.: 16/184,626

(22) Filed: Nov. 8, 2018

Related U.S. Application Data

(60) Provisional application No. 62/583,297, filed on Nov. 8, 2017.

(51) Int. Cl.
*E06B 9/52* (2006.01)

(52) U.S. Cl.
CPC ..... *E06B 9/52* (2013.01)

(58) Field of Classification Search
CPC ..... Y10T 24/44026; Y10T 292/34; Y10T 292/37; Y10T 292/426; Y10T 292/432; Y10T 292/03; Y10T 292/1028; Y10T 292/1022; Y10T 292/0911; Y10T 24/44043; Y10T 24/44051; F16B 5/06; F16B 17/00; F16B 2/20; F16B 2/22; F16B 5/0036; F16B 5/126; F16B 5/0692; E06B 9/52; E06B 2009/527; G09F 15/0018; G09F 15/0025; G09F 2007/1886; G09F 2003/0468
See application file for complete search history.

(56) References Cited

U.S. PATENT DOCUMENTS 3,818,550 A * 6/1974 Cresswell ..... E04D 5/147 24/462
4,662,038 A * 5/1987 Walker ..... F16B 5/0692 160/395
4,887,626 A * 12/1989 Dalo ..... E04H 15/644 135/907
5,358,293 A * 10/1994 Bradley, Jr. ..... E05C 19/18 292/269
5,664,814 A * 9/1997 Lin ..... E05C 19/182 292/288
9,163,454 B1 * 10/2015 Hopson ..... E06B 9/52
10,465,735 B1 * 11/2019 Hsieh ..... F16B 37/043
(Continued)

FOREIGN PATENT DOCUMENTS

CA 2472836 A1 * 1/2006 ..... E04H 15/646
CN 101761528 A * 6/2010 ..... F16B 5/065
(Continued)

*Primary Examiner* — Johnnie A. Shablack
*Assistant Examiner* — Matthew R. Shepherd
(74) *Attorney, Agent, or Firm* — Glenn E. Gold, P.A.; Glenn E. Gold

(57) ABSTRACT

A two-piece device for selectively retaining a peripheral portion of a panel of screen mesh material within a spline track of a screen enclosure frame member includes a first piece functioning as a main body and a second piece functioning as a locking member, which is received through the main body slot. During use, a peripheral edge of a screen panel is draped over a spline-receiving track of a screen enclosure frame member, a hook portion of a planar base portion of the main body is inserted into the spline-receiving track, and the locking member is lowered to wedge the device into the track to temporarily pin the screen in place while a user inserts spline into the track.

10 Claims, 13 Drawing Sheets

(56) References Cited

U.S. PATENT DOCUMENTS

| | | | | |
|---|---|---|---|---|
| 11,124,155 | B2 * | 9/2021 | Hong | F16B 17/00 |
| 2008/0130238 | A1 * | 6/2008 | Yang | H01L 23/4093 361/719 |
| 2013/0152346 | A1 * | 6/2013 | Kim | B60R 13/0206 24/289 |
| 2014/0000071 | A1 * | 1/2014 | Choi | F16B 2/22 24/543 |
| 2014/0363224 | A1 * | 12/2014 | Iwahara | F16B 5/065 403/326 |
| 2015/0107064 | A1 * | 4/2015 | Perez | F16B 5/065 24/564 |
| 2015/0211565 | A1 * | 7/2015 | Benedetti | F16B 21/075 24/292 |
| 2017/0128868 | A1 * | 5/2017 | Simmons | E06B 9/52 |
| 2022/0042530 | A1 * | 2/2022 | Chang | F16B 17/00 |

FOREIGN PATENT DOCUMENTS

| | | | | | |
|---|---|---|---|---|---|
| CN | 112406649 | A | * | 2/2021 | A47C 31/023 |
| FR | 2562988 | A1 | * | 10/1985 | F16B 5/0692 |
| FR | 2575243 | A1 | * | 6/1986 | F16B 5/0692 |
| FR | 2840964 | A1 | * | 12/2003 | B44D 3/185 |
| WO | WO-2005019660 | A1 | * | 3/2005 | F16B 5/0692 |

* cited by examiner

SCREEN RETENTION DEVICE AND METHOD OF USE

CROSS-REFERENCE TO RELATED APPLICATION(S)

This U.S. non-provisional patent application claims the benefit and priority of U.S. provisional patent application No. 62/583,297, filed on Nov. 8, 2017 by the same inventor, the entire contents of which are incorporated-by-reference herein.

FIELD OF THE INVENTION

This invention generally relates to patio screen enclosure systems in which lengths of spline are employed to affix peripheral edge portions of screen mesh panels into spline tracks of aluminum framing members used to form a screen enclosure frame work.

BACKGROUND OF THE INVENTION

Patio screen enclosures are well known. Conventional patio screen enclosure systems generally incorporate a rigid framework structure that is typically assembled by attaching extruded aluminum frame members of varying lengths to one another, either directly or indirectly, using well-known hardware, such as brackets, plates, fasteners, and the like. The aluminum frame members are normally extruded in the form of hollow, four-sided, rectangular (e.g. square) cross-sectional geometries. Typically, such extrusions are provided having integral spline tracks—alternatively referred to as channels, grooves, and the like—running longitudinally along or adjacent to peripheral edges of at least one side of the length of extrusion. The individual framing lengths, mostly oriented either horizontally or vertically, are attached to one another, typically at framing length ends, using fasteners, brackets and other hardware components.

Panels of screening are installed in a taut, or tensioned, condition each extending between a series of adjoined frame members defining a framework opening. More specifically, a continuous peripheral edge portion of a panel of screen material is frictionally secured within a continuous spline track, formed by aligned lengths of a series of respective frame member spline tracks of adjoined framing members, with the use of corresponding lengths of a spline material compressed into the spline tracks. Conventional spline is a type of vinyl cording that fixes the panels of screening material into the screen support framework openings by compressing peripheral edge portions of the screen panel into the spline tracks with the spline lengths. More specifically, a peripheral edge portion of the screen panel is initially disposed over a length of spline track, and a length of spline subsequently disposed over the screen panel peripheral edge portion is pressed, or squeezed, into corresponding spline track lengths using a spline roller, screen mouse, or other tool specifically designed to facilitate insertion of the spline into the spline tracks, or grooves, in a smooth, fluid motion.

As anyone whom has ever installed patio screening can attest to, it is extremely difficult for an individual to install screen material alone (i.e. without assistance from one or more other individuals to help maintain the screen material in place along the individual frame members while the spline is inserted into the spline tracks). Moreover, even with assistance the difficulty installing screen mesh is exacerbated during even moderate winds. Accordingly, it would be highly desirable to have a device that could be employed by both professional installers and do-it-yourself homeowners to facilitate the installation of screen mesh material alone, under windy conditions, etc. Preferably, such a device would provide an inexpensive, easy-to-use, means for temporarily retaining user-selectable peripheral portions of a screen panel in place such that a screen installer is left with both hands freely available for use running spline above the screen mesh periphery overlaying the frame member spline tracks, and subsequently compressing the spline, and corresponding screen mesh, into the spline tracks.

Preferably, such a device would have a design lending itself to easy, inexpensive manufacturability. Furthermore, it would be highly desirable to provide such a device enabling peripheral portions (e.g. at or near the corners) of a rectangular screen mesh to be efficiently and effectively releasably secured in place along a spline track at any user-desired position, and subsequently removed to enable the user to continue installation of the spline along the spline track.

It would be highly desirable for such a device to incorporate a feature for enabling an individual user to easily and efficiently align the spline with the underlying spline track while leaving the user's hands free to facilitate insertion of the spline, and underlying screen mesh, therein.

SUMMARY OF THE INVENTION

The present invention provides such a screen retention device that is inexpensive to manufacture, easy to use, and highly effective addressing the aforementioned issues associated with the installation of screen mesh material during the assembly of conventional screen enclosures. In accordance with a preferred exemplary implementation, a device provided for selectively retaining a peripheral portion of a panel of screen mesh material within a spline track of a screen enclosure frame member includes:

(a) a one-piece main body having a geometry at least partially defined by a low-profile central body portion having a planar upper surface bounded by generally-thickened left and right end portions having respective opposing left and right end portion surfaces defining respective opposing left and right thickened end portion vertical recesses each having a recess width, the central body portion including a slot extending completely therethrough and defined by a slot width and a slot length, the slot length extending laterally between the vertical recesses of the thickened end portions, and the central body portion including a planar lower surface having a laterally-extending hook portion extending downwardly therefrom; and (b) a one-piece locking member in engagement with the main body, the locking member slidably received through the laterally-extending central body portion slot of the one-piece main body, the unitary locking member having a geometry at least partially defined by a locking member upper portion having a first thickness and a locking member lower portion having a second, reduced thickness, wherein the locking member upper and lower portions are adjoined by a laterally-extending shoulder, and a lower distal end portion of the lower portion of the locking member at least partially defined by a laterally-extending thickened lower edge feature.

In accordance with an aspect of the invention, the locking member upper portion may be provided in the form of a hand-gripping upper edge portion for facilitating user manipulation of the device during insertion into a spline track, locking of the device within the spline track, and subsequent removal of the device from the spline track.

In accordance with a further significant aspect of the invention, a spline-retaining slot may be provided extending into the hand-gripping upper edge portion of the device locking member and, preferably, an additional distance into the locking member upper portion. Significantly, the spline-retaining slot enables a user of the device—while securing the periphery of a screen mesh panel to a corresponding contiguous spline track, formed by a series of attached frame members, with spline—to temporarily frictionally retain a length of spline, at user-selected points along the spline length, within the spline slot of a device temporarily secured within the spline track during the process of inserting spline into the spline track over the screen mesh. Advantageously, the spline slot feature is located along the hand-gripping upper edge portion of the device such that the spline slot is in alignment with the underlying frame member spline track opening, thereby providing the beneficial function of facilitating alignment of the spline length with the screen-overlaid spline track while enabling the user to maintain both hands free. In this manner, the screen installer may use one hand to pull the spline taut above, and perfectly aligned with, the underlying spline track (and correspondingly above the overlying screen material), while concurrently using the other hand to insert and force, or compress, the tensioned spline length (e.g. with a spline roller tool, etc.) and underlying screen mesh material into the spline track.

In accordance with another aspect, opposite left and right ends of the upper portion of the locking member main body may be slidably received through respective opposing left and right thickened end portion vertical recesses of the unitary main body, wherein the width of the vertical recesses is sized nominally greater than the corresponding thickness of the upper portion of the locking member main body, and the distance between the opposing inwardly-facing surfaces of the respective vertical recesses is nominally greater than the corresponding width of the locking member main body, thereby restricting lateral displacement of the unitary locking member vis-à-vis the unitary main body while enabling vertical sliding displacement therethrough.

In accordance with another aspect, the locking member lower portion may be slidably received through the central body portion slot of the unitary main body, wherein the unitary main body laterally-extending slot may have a slot width nominally greater than the corresponding thickness of the locking member lower portion, along with a slot length nominally greater than a corresponding lateral length of the locking member lower portion, thereby restricting lateral displacement of the unitary locking member vis-à-vis the unitary main body while enabling vertical sliding displacement therethrough.

In accordance with another aspect, the laterally-extending thickened lower edge feature of the lower distal end portion of the lower locking member portion may include a shoulder defining, and functioning as, a stop limit during upward movement, or translation, of the unitary locking member with respect to the unitary main body In a further aspect, the reduced thickness of the lower portion of the locking member may be in the form of a recessed, inset planar portion, or area, of a front (or rear, depending upon the respective orientation) planar surface of the locking member.

In a further aspect, the laterally-extending shoulder adjoining the upper and lower portions of the locking member may be in the form of a downwardly-facing planar surface defining, and functioning as, a stop limit during downward translation, or movement, of the unitary locking member with respect to the unitary main body. The downwardly-facing planar surface of the laterally-extending locking member shoulder is preferably positioned to for direct contact engagement with the corresponding planar upper surface of the low-profile central body portion of the unitary main body during downward translation, or movement, of the unitary locking member with respect to the unitary main body during a locking function of the device within a spline track to temporarily retain the user selected portion of the panel of screen mesh material therein.

In accordance with another aspect, a corresponding method is provided for employing the device of the present invention to selectively retain a peripheral portion of a panel of screen mesh material within a spline track of, for example, a conventional screen enclosure extruded aluminum frame member. Such conventional frame member spline tracks are typically defined, at least in part, by a bottom side, a pair of generally vertical sidewalls extending upwardly from opposite ends of the bottom side, and a lip extending inwardly from an upper end of one of the frame member sidewalls to define an upper spline track opening in communication with a spline track interior space. The method may include the following steps:

(a) providing a device having a two-piece construction particularly configured for being selectively fixedly secured within the spline track, the device including:

(1) a main body having a geometry at least partially defined by a low profile central body portion having a planar upper surface bounded by generally-thickened left and right end portions having respective opposing left and right end portion surfaces defining respective opposing left and right thickened end portion vertical recesses each having a recess width, the central body portion including a slot extending completely therethrough, the slot having a slot width and a slot length, the slot length extending laterally between the thickened end portion vertical recesses, and a central body portion planar lower surface having a laterally-extending hook portion depending downwardly therefrom; and (2) a unitary locking member slidably received through the laterally-extending central body portion slot of the unitary main body, the unitary locking member having a geometry at least partially defined by a locking member upper portion having a first thickness and a locking member lower portion having a reduced second thickness, the locking member upper and lower portions adjoined by a laterally-extending first shoulder, a lower distal end portion of the reduced thickness locking member lower portion at least partially defined by a laterally-extending thickened lower edge feature defining a laterally-extending second shoulder;

(b) disposing, or skirting, a peripheral edge portion of the screen mesh material over the screen enclosure frame member such that the screen mesh material covers the frame member upper spline track opening;

(c) biasing the unitary locking member into a raised, unlocked position with respect to the main body of the device, and positioning the device such that the downwardly-depending hook portion of the locking member is located a nominal distance directly above the mesh screen-covered spline track such that a longitudinal axis of the locking member hook portion is in parallel alignment with a corresponding longitudinal axis of the spline track opening;

(d) orienting the device such that a central cutting plane vertically dissecting the locking member main body is sufficiently angularly offset from a vertical orientation to enable the laterally-extending hook portion depending downwardly from the central body portion planar lower surface of the locking member to be at least partially inserted through the upper spline track opening and into a spline track interior space;

(e) angularly rotating the device from the oriented position back to a vertical orientation wherein the central cutting plane vertically dissecting the locking member main body (upper) portion is oriented perpendicular to the longitudinal axis of the spline track opening, and wherein the size, shape, and configuration of the laterally-extending downwardly-depending hook portion of the main body of the device, coupled with the laterally-extending thickened lower edge feature of the locking member lower portion and a corresponding area of the screen mesh material peripheral edge portion become compressed within the spline track, and the planar lower surface of the central body portion of the main body is in direct contact with an upper surface of the frame member; and (f) slidably-lowering the unitary locking member vis-à-vis the main body to further compress the main body hook portion, the laterally-extending thickened lower edge feature of the locking member lower portion, and the corresponding area of the screen mesh material peripheral edge portion within the spline track.

In an aspect of the method wherein the locking member main body (i.e. upper portion) is provided having a hand-gripping edge portion with a spline-retaining slot extending therethrough, the method may include the following additional step: (g) running spline through the spline-retaining slot at a location along a length of the spline, prior to inserting the spline length into a corresponding underlying screen mesh-covered spline track, such that the length of spline may be easily pulled taut with one hand of a device user, thereby accurately positioning the length of spline directly above the corresponding underlying screen mesh material-covered spline track to facilitate subsequent insertion into the underlying spline track with the other (second) hand of a device user (e.g. using a conventional spline roller apparatus).

BRIEF DESCRIPTION OF THE DRAWINGS

The invention will now be described, by way of example, with reference to the accompanying figures, where like numerals denote like elements, and in which.

DETAILED DESCRIPTION OF EXEMPLARY IMPLEMENTATION(S)

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. There is no intention to be bound by any expressed or implied theory presented in the preceding technical field, background, brief summary or the following detailed description. It is also to be understood that any specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 11A:
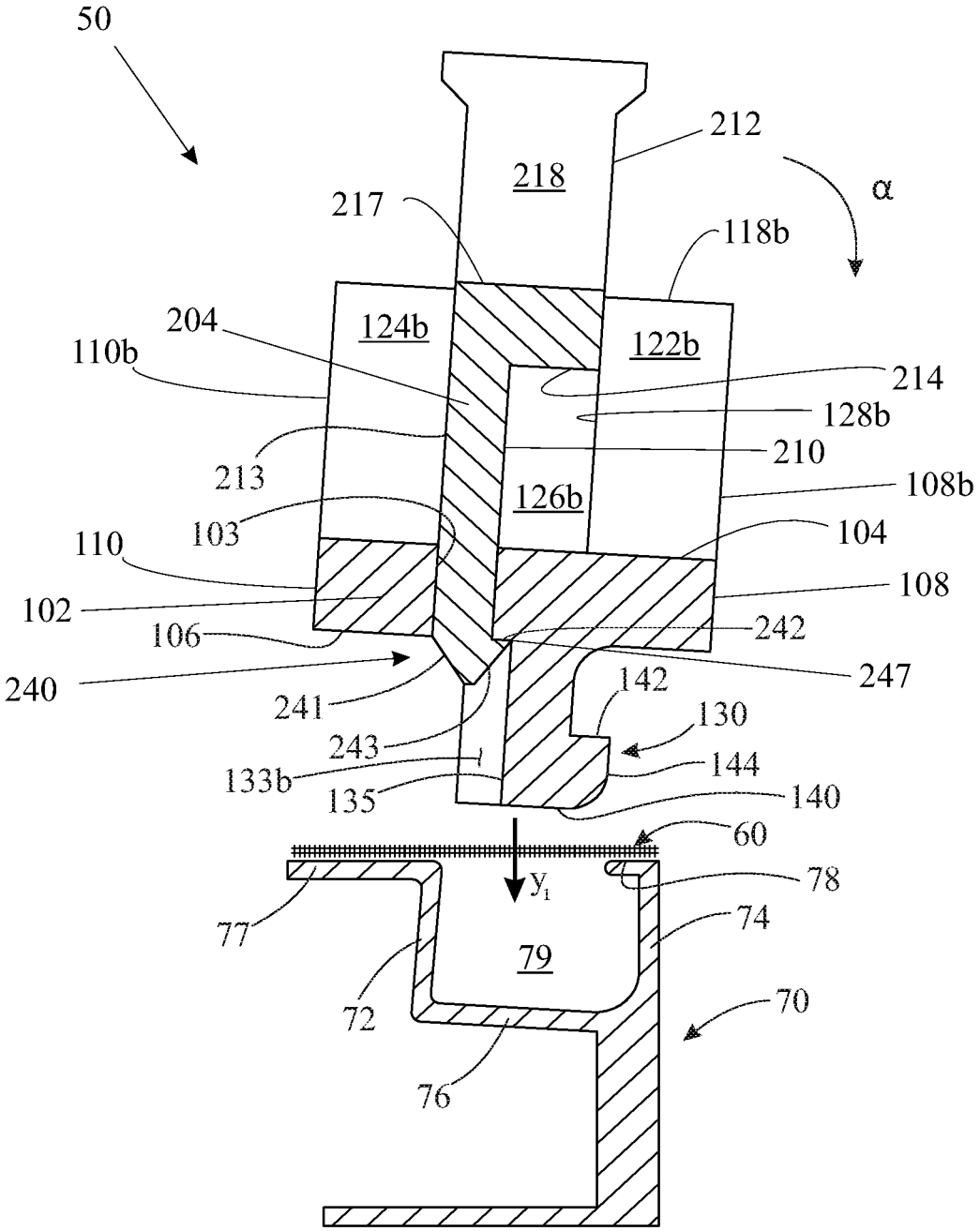
FIGS. 11A-11C are a series of cross-sectional views generally showing a corresponding series of steps employing the inventive device 50 to temporarily retain a peripheral portion of a panel of screen mesh material 60 within the spline track 79 of a frame member 70.
Figure 11B:
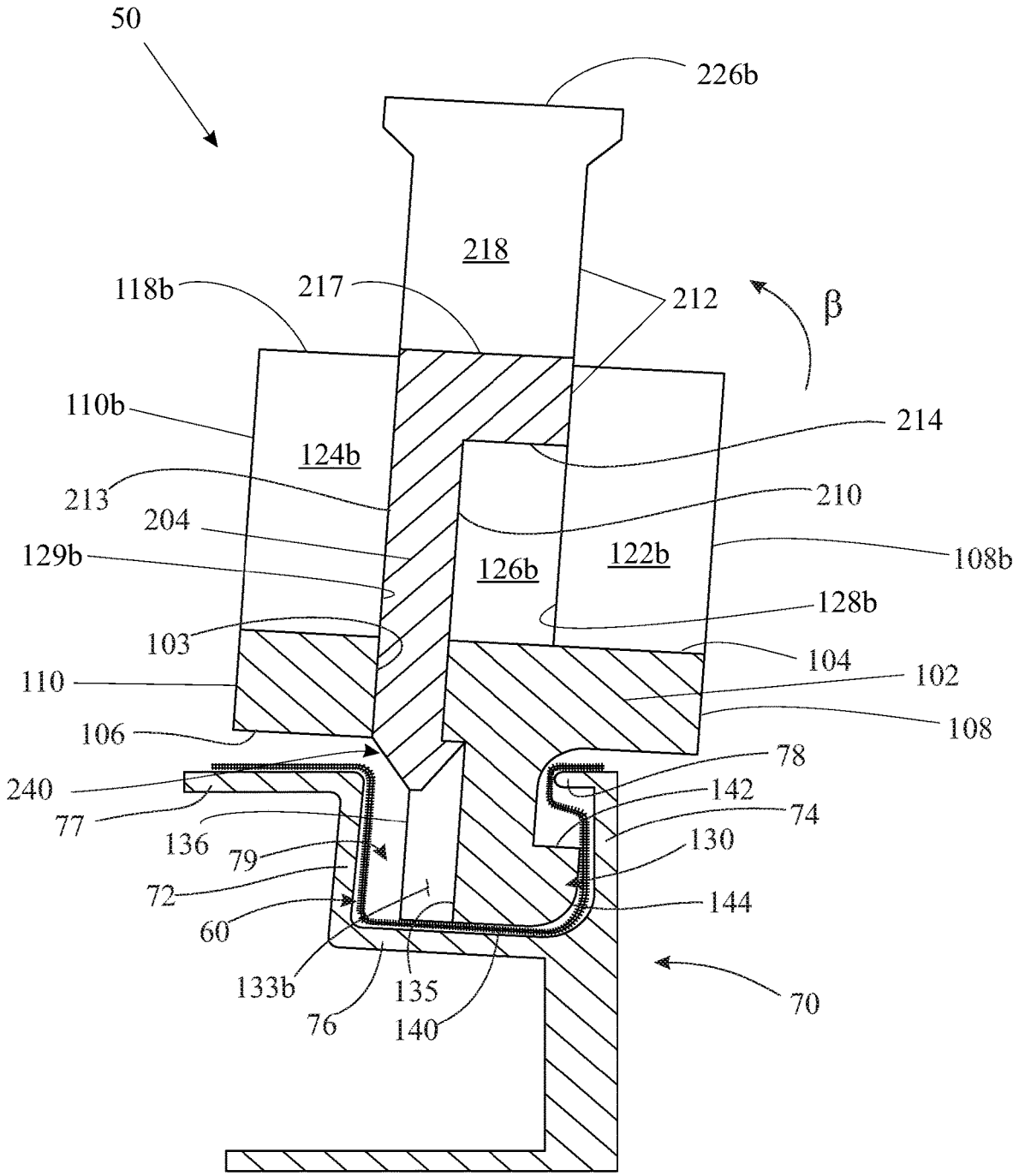
Figure 11C:
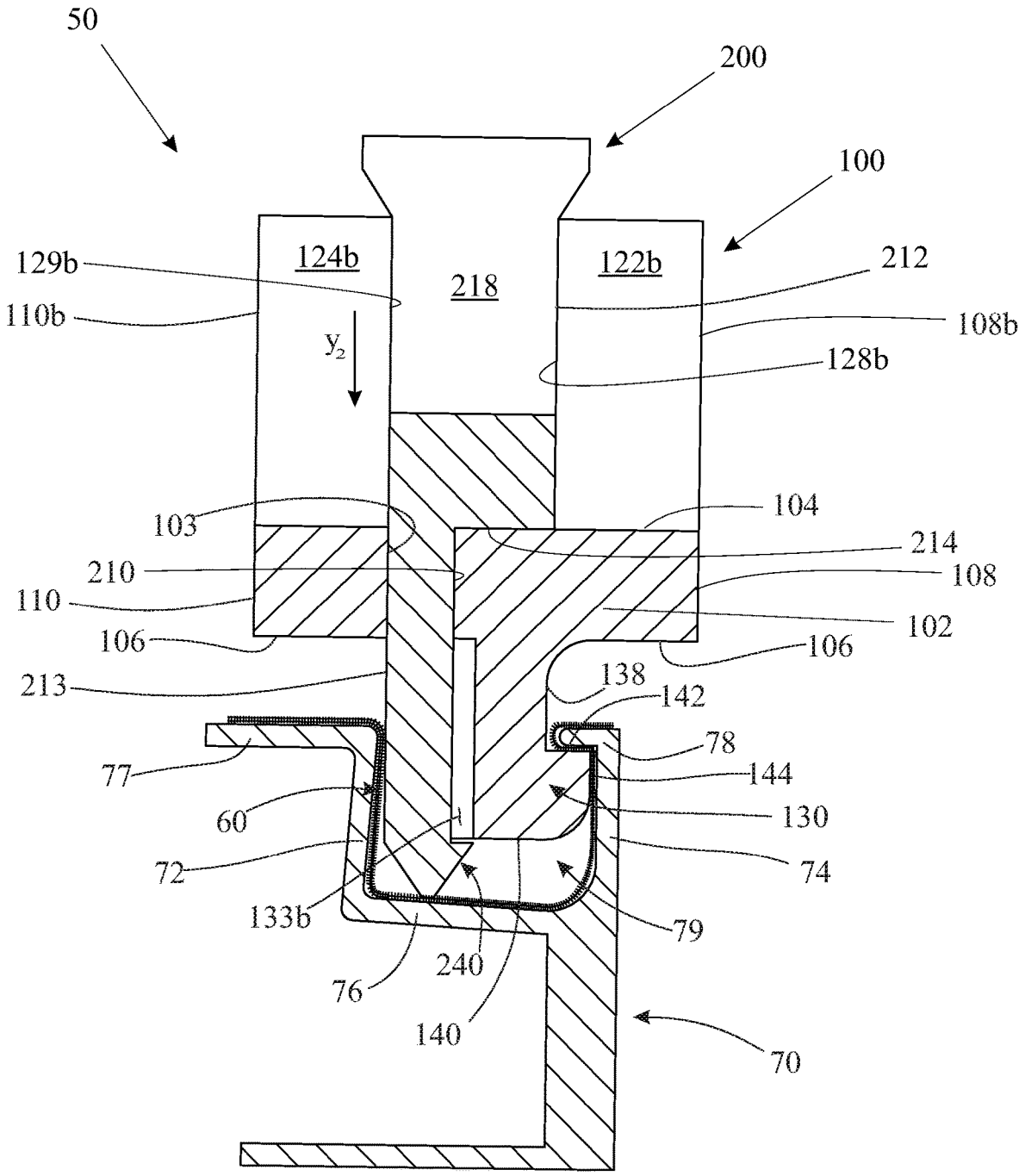

An exemplary implementation of the screen retention device of the present invention is shown generally as reference numeral 50 in accompanying drawing FIGS. 1-10. Furthermore the device 50 is shown in FIGS. 11A-11C, depicting an exemplary method for using the device 50 to temporarily retain a peripheral edge portion of a panel of screen mesh material 60 within a spline track interior space 79 of a frame member 70 a conventional screen enclosure. In accordance with a preferred implementation, the device 50 incorporates two individual components in sliding engagement with one another; a main body 100, and a slidable locking member 200.

In the accompanying drawings, FIGS. 1-5 show the screen retention device, or apparatus, in an unlocked state, ready for use to temporarily selectively secure a peripheral edge portion of a panel, or area, of screen mesh material during installation of a conventional screen enclosure in which lengths of spline are used to mount panels of screen mesh material across openings defined by individual frame members, wherein the spline is compressed within the spline tracks, over the screen periphery, to secure the screen panels in tension. Furthermore, FIGS. 6-10 show the screen retention device 50 in a locked state while being used to temporarily selectively fix a peripheral edge portion of a panel, or area, of screen material during installation of a screen enclosure, thereby enabling the use of both hands, by a screen installer, to permanently secure peripheral edge portions of the screen proximate to the screen retention apparatus within corresponding spline track lengths with lengths of spline material.

Referring now to FIGS. 1-10, main body 100 and locking member 200 each preferably have a unitary, or one-piece, structure that may be constructed using any of myriad known materials and available manufacturing techniques. Preferably, the individual components 100, 200 are formed using a plastic molding technique such as, for example, injection molding. With regard to injection molding, some common available thermoplastics broadly include Acrylonitrile Butadiene Styrene (ABS), Polyethylene, Polycarbonate, Polyamide (Nylon), High-Impact Polystyrene, and Polypropylene, to name just a few. Again, the particular choice of material and manufacturing technique is not intended to be limiting.

Initially, it should be noted that applicant has used lower case letters (i.e. "a" and "b") after some reference numbers in order to distinguish between identical features, albeit, having opposite orientations in some cases, located at opposite ends (i.e. left and right ends) of main body 100 (and below with regard to locking member 200) merely for the purpose of clarity. Main body 100 has a geometry that is broadly defined by a centrally located low-profile planar base 102 having a generally planar upper surface 104, an opposite generally planar lower surface 106, a front surface 108 and an opposite rear surface 110. Furthermore, as described in further detail below, a laterally-extending slot 103 is provided extending completely through planar base 102, for receiving a lower portion 204 of slidable locking member 200 therethrough. Upper surface 104 of main body 100 incorporates right and left thickened main body portions, 116*a* and 116*b*, respectively, at opposite right and left ends, 112 and 114, respectively. The precise geometry of the thickened portions 116*a*, 116*b* is merely exemplary and is not intended to be limiting.

The particular geometry of right-side thickened portion 116*a* is defined by front surface 108*a*, rear surface 110*a*, upper surface 118*a* (adjoined to right end 112 by concave transition surface 120*a*), front left-facing surface 122*a*, rear left-facing surface 124*a*, central left-facing surface 126*a*, rear-facing surface 128*a*, and front-facing surface 129*a*. As described in greater detail below, right-side surfaces 126*a*, 128*a*, and 129*a*, together define a right thickened end portion vertically-oriented recess having a width (and a depth) sized, shaped, and otherwise configured for accommodating the right end 222 of main body 202.

Likewise, the particular geometry of left-side thickened portion 116*b* is defined by front surface 108*b*, rear surface 110*b*, upper surface 118*b* (adjoined to left end 114 by concave transition surface 120*b*), front right-facing surface 122*b*, rear right-facing surface 124*b*, central right-facing surface 126*b*, rear-facing surface 128*b*, and front-facing surface 129*b*. Again, as stated above with regard to thickened right end surface portion 116*a*, left-side surfaces 126*b*, 128*b*, and 129*b*, together define a left thickened end portion vertically-oriented recess having a width (and a depth) sized, shaped, and otherwise configured for accommodating the left end 220 of main body 202.

Figure 1:
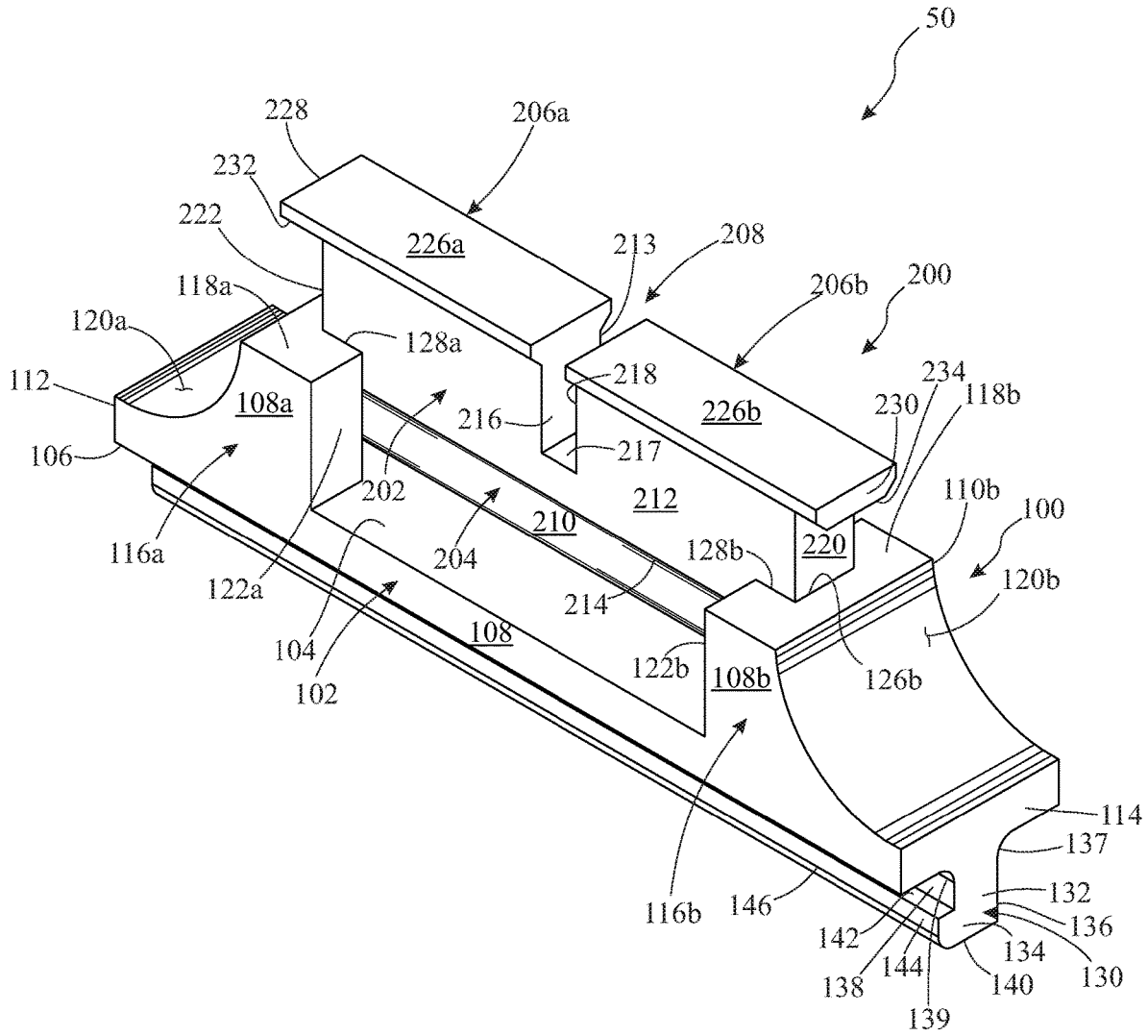
FIG. 1 is a front-top-right perspective view of a screen retention device (50) in accordance with the present invention, with the sliding component (200) shown in a raised position relative to the base component (100)
Figure 2:
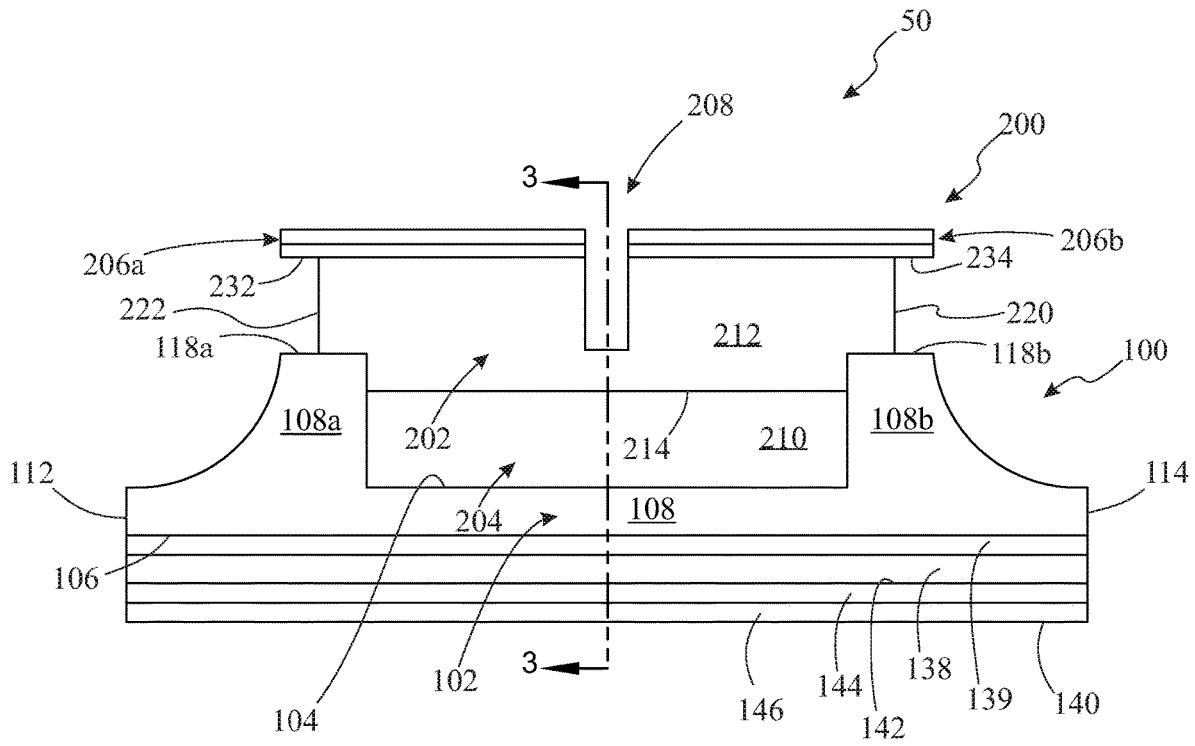
FIG. 2 is a front elevation view of the screen retention device shown in FIG. 1.
Figure 3:
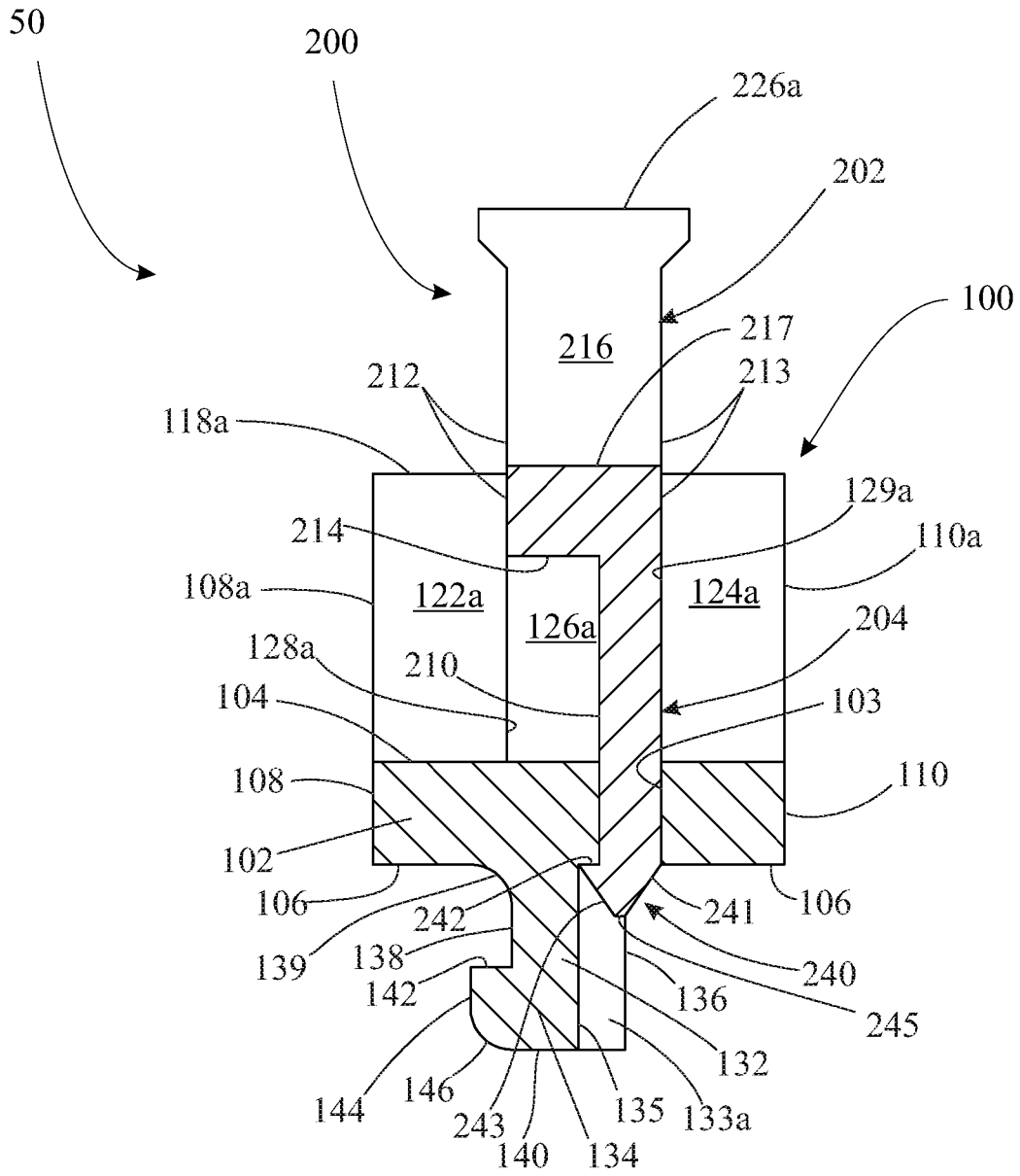
FIG. 3 is a cross-sectional view taken along section line 3-3 of FIG. 2 (i.e. through the center of spline slot 208)
Figure 4:
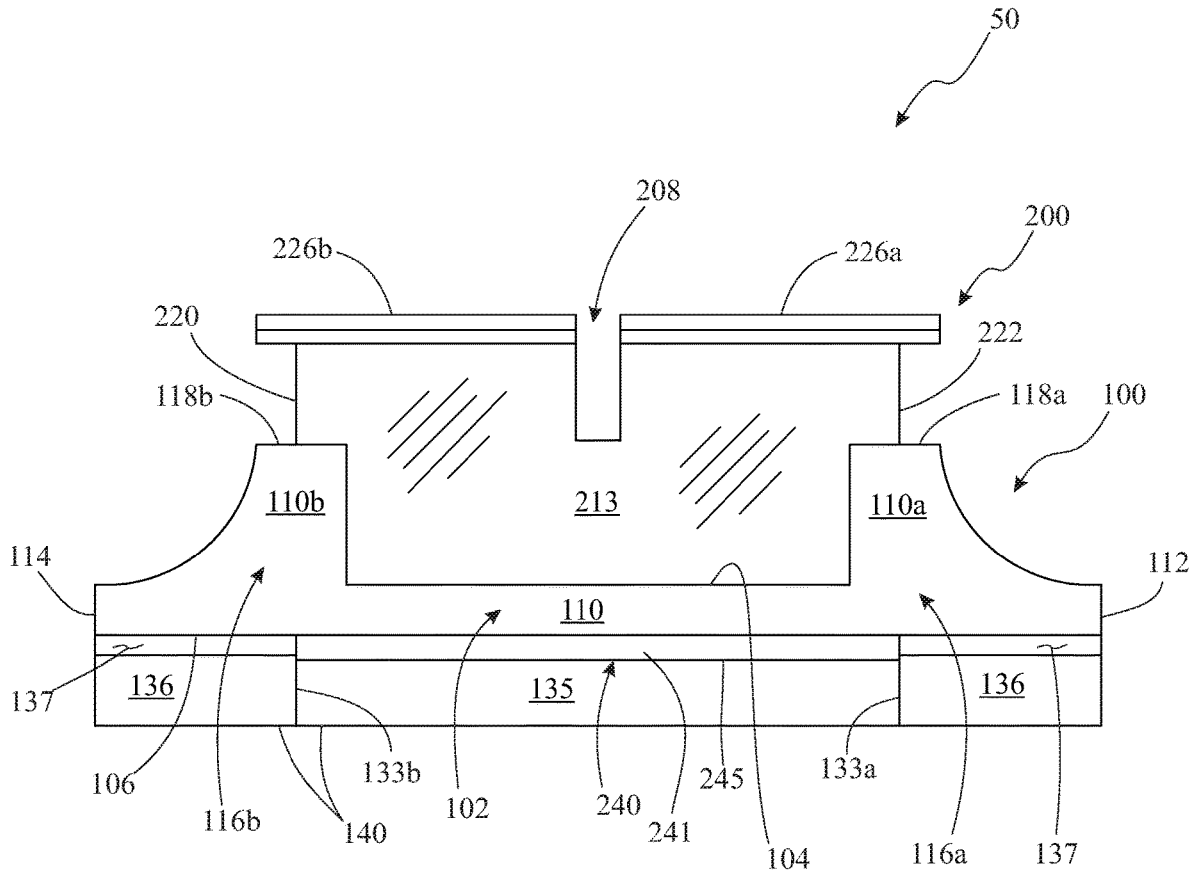
FIG. 4 is a rear elevation view of the screen retention device shown in FIG. 1.
Figure 5:
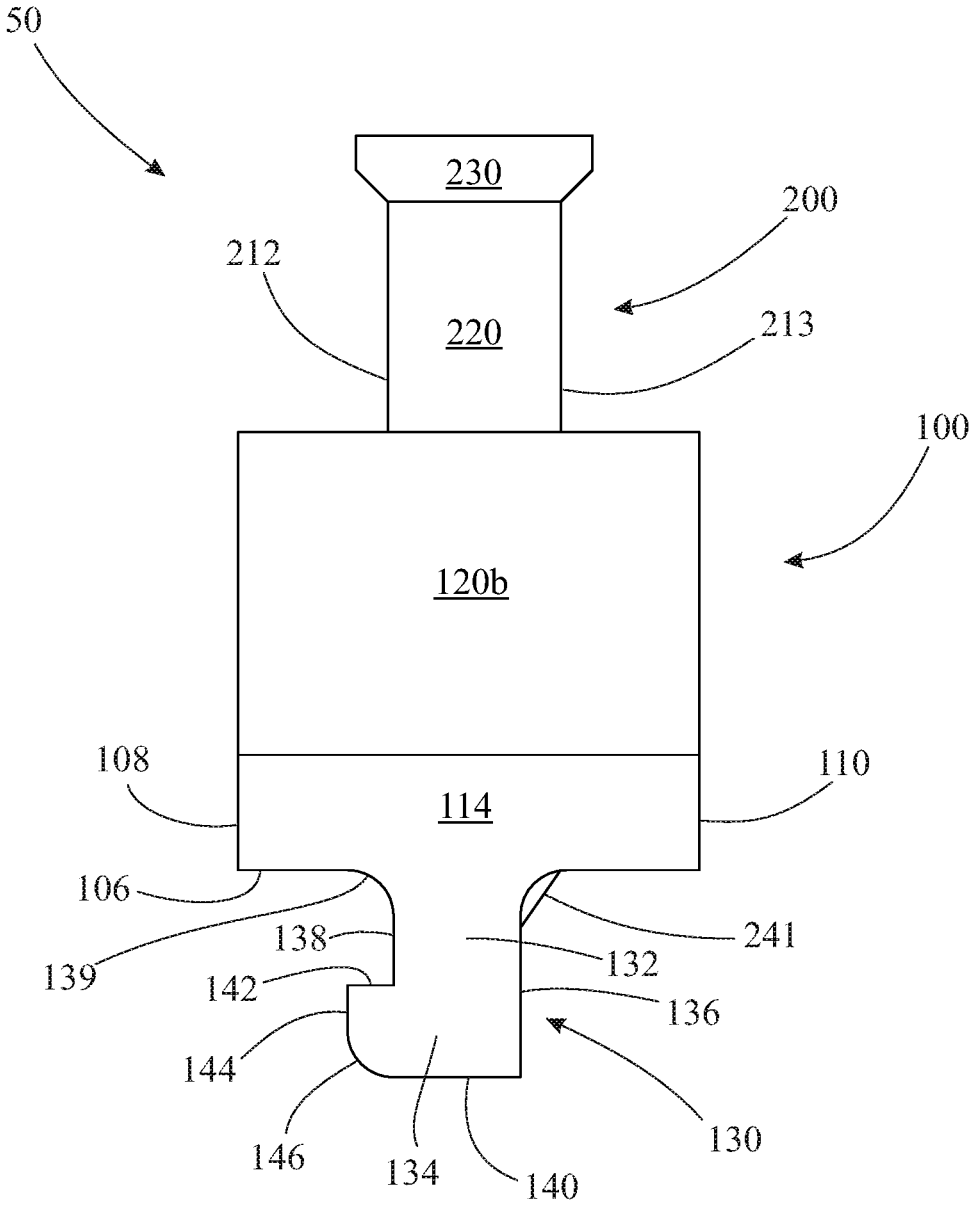
FIG. 5 is a left end view of the screen retention device shown in FIG. 1.
Figure 6:
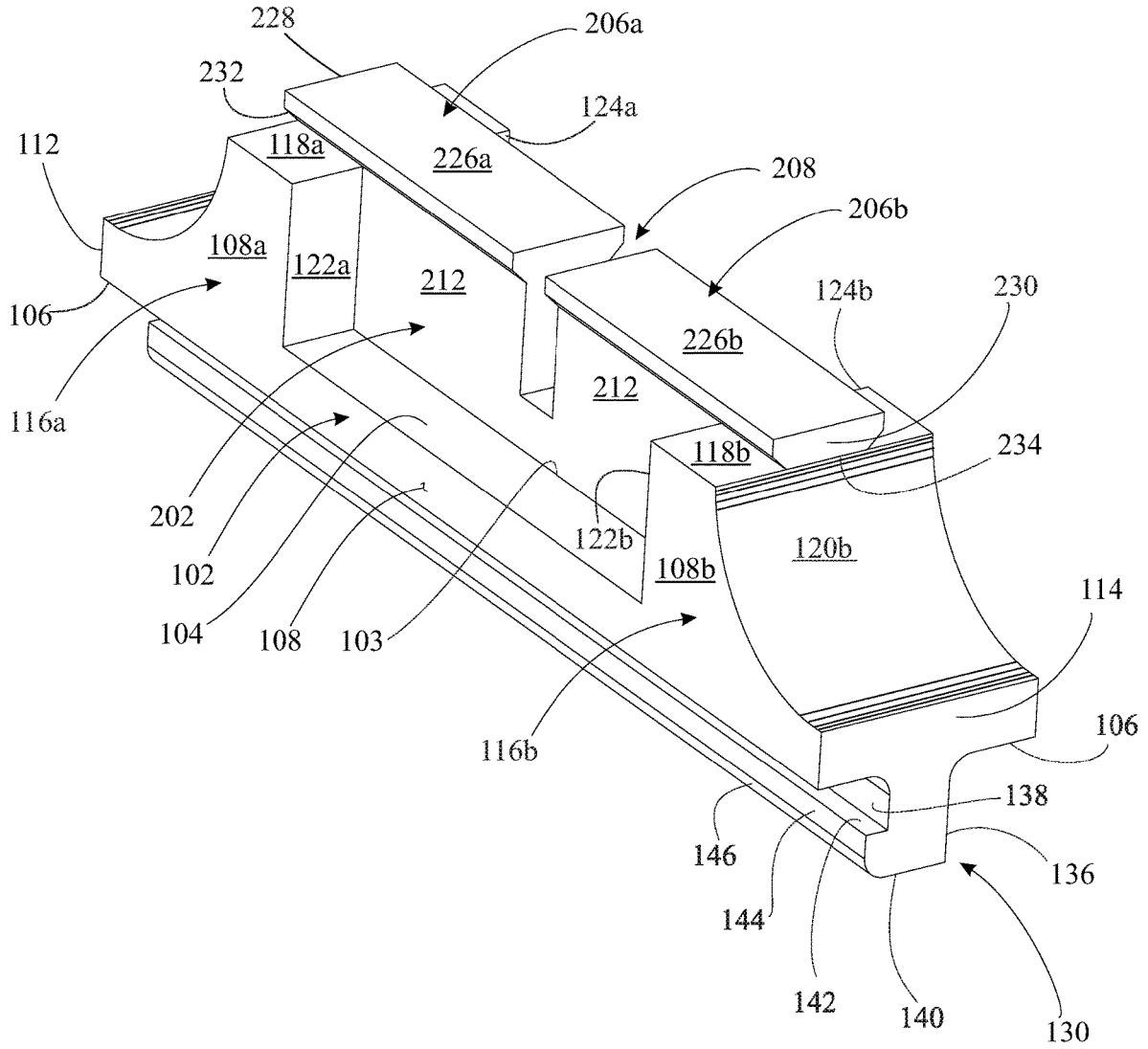
FIG. 6 is a front-top-right perspective view of a screen retention device (50) in accordance with the present invention, with the sliding component (200) shown in a lowered position relative to the base component (100)
Figure 7:
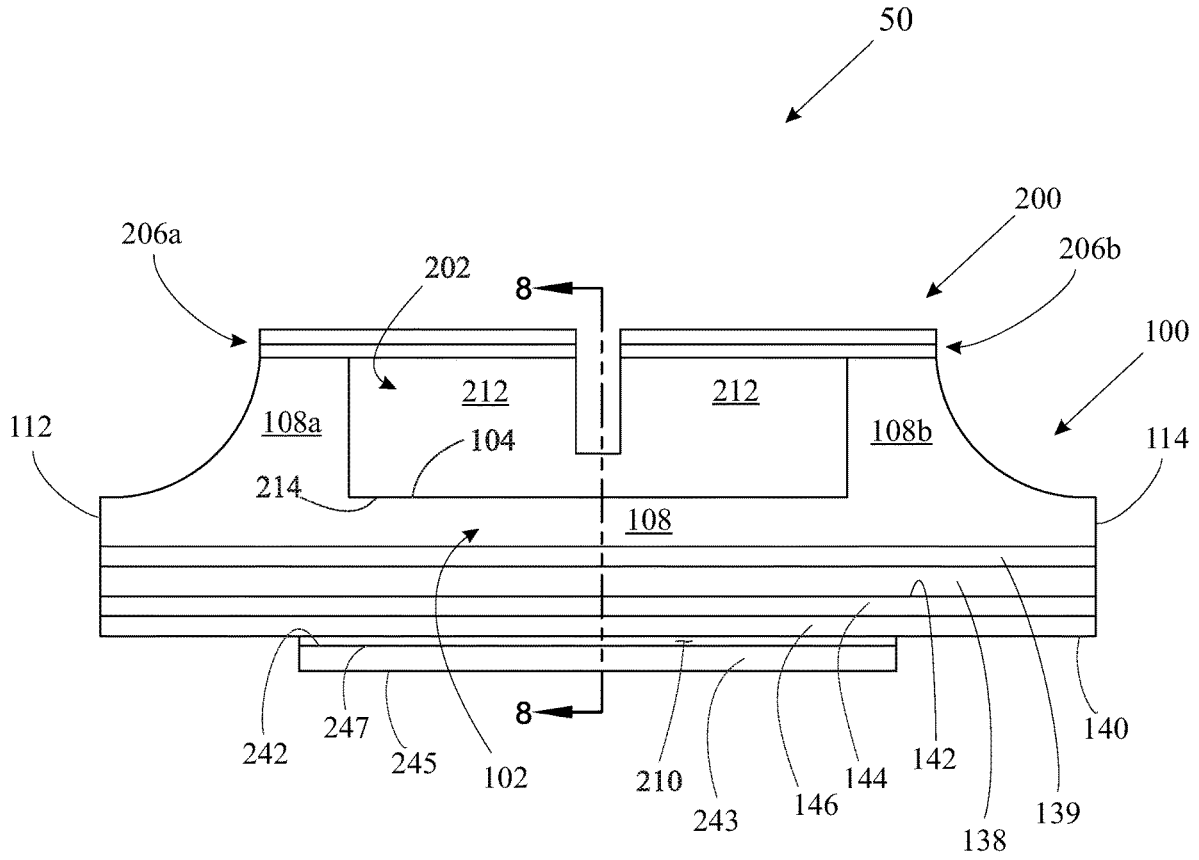
FIG. 7 is a front elevation view of the screen retention device shown in FIG. 6.
Figure 8:
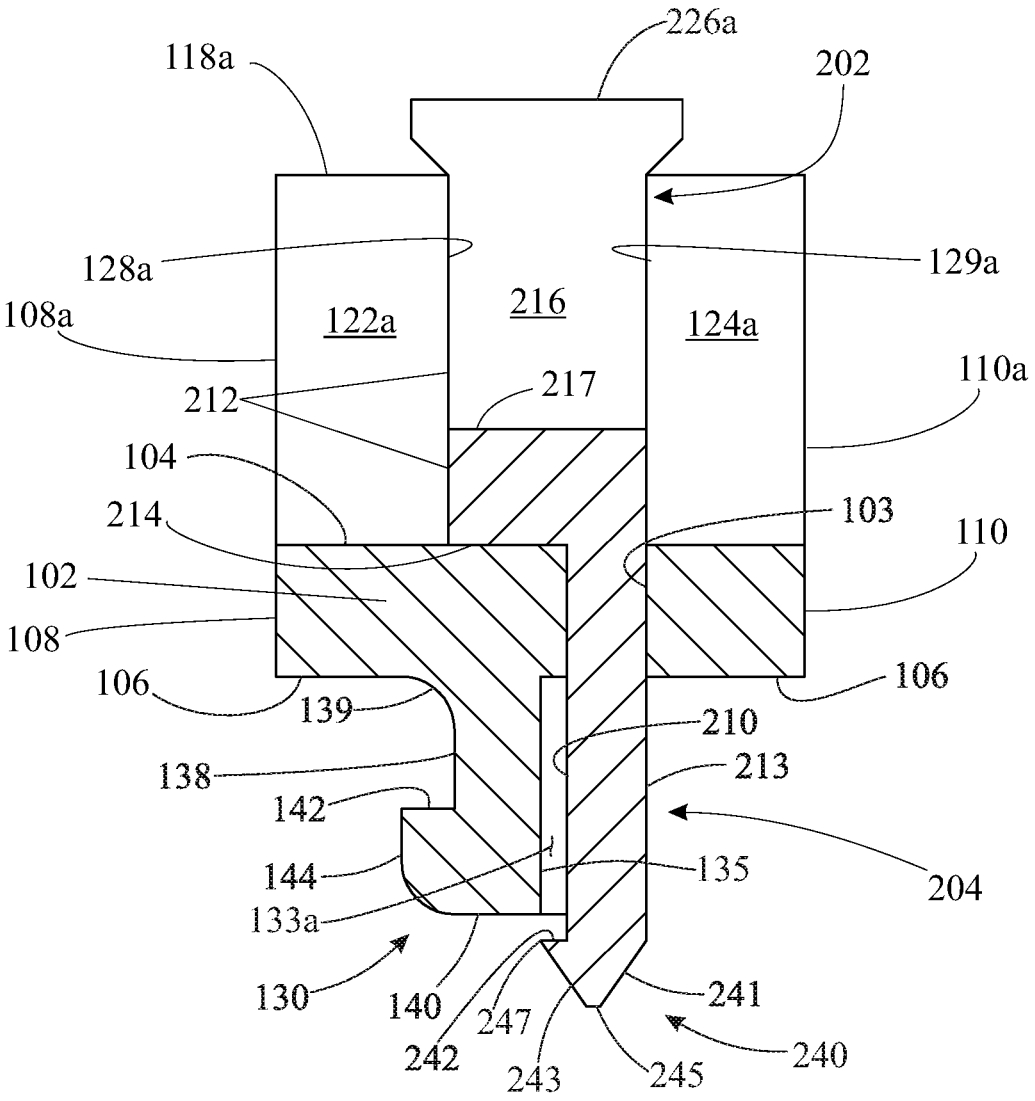
FIG. 8 is a cross-sectional view taken along section line 8-8 of FIG. 7.
Figure 9:
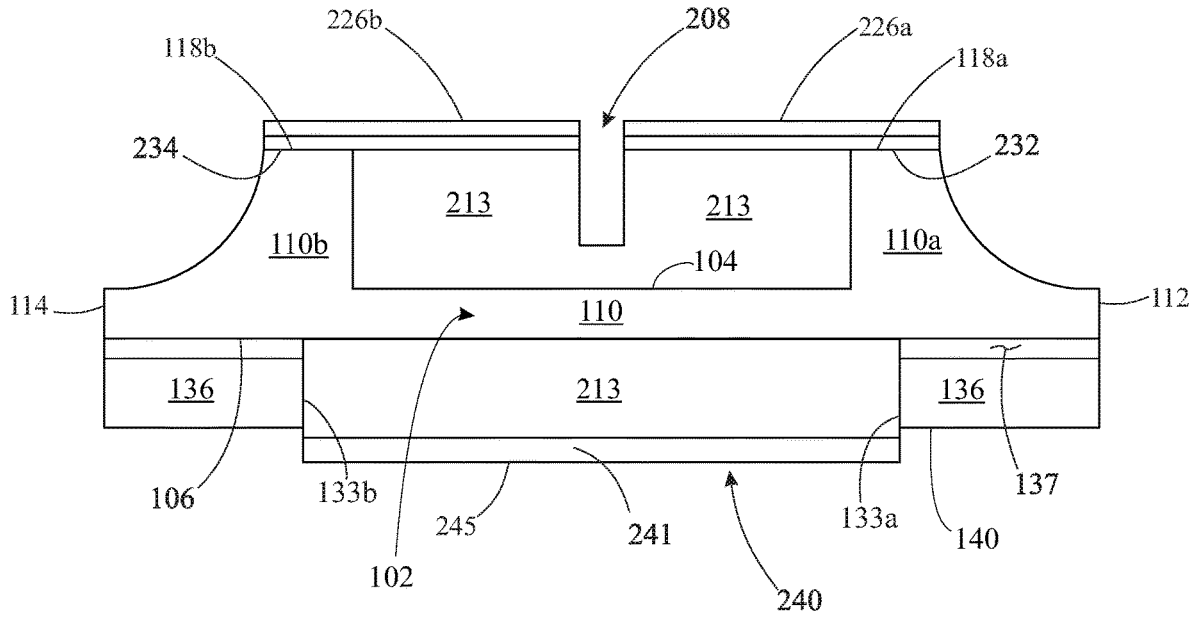
FIG. 9 is a rear elevation view of the screen retention device shown in FIG. 6.
Figure 10:
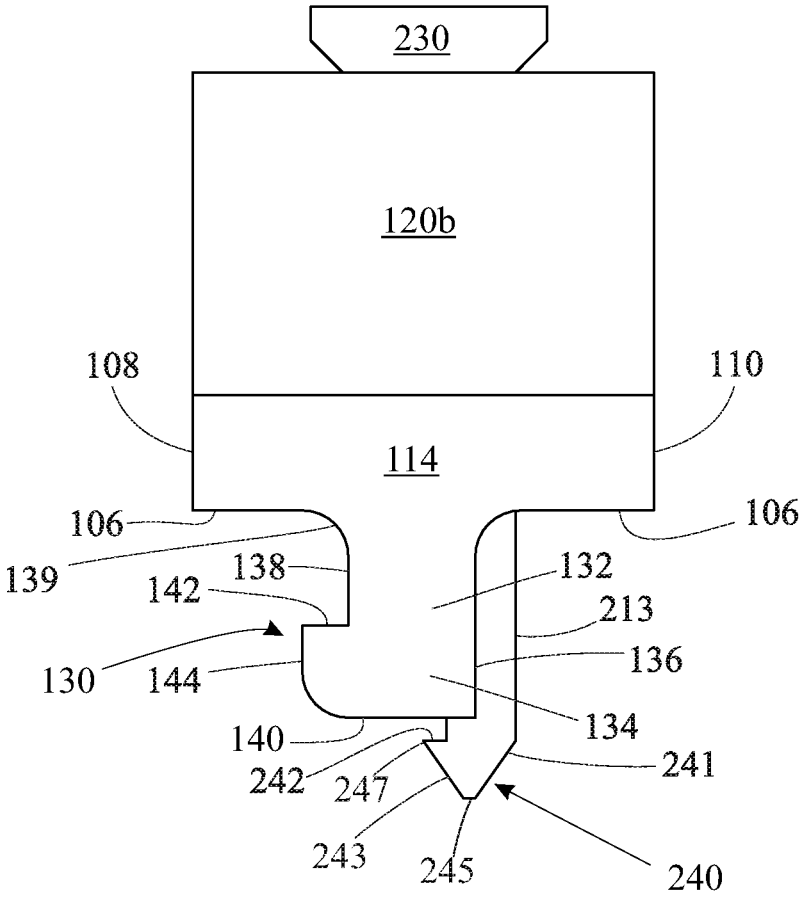
FIG. 10 is a left end view of the screen retention device shown in FIG. 6.

Planar lower surface 106 has an integral laterally-extending hook portion, shown generally as reference numeral 130, depending downwardly therefrom, the purpose of which is explained in further detail below. Downwardly-depending hook portion 130 has a cross-sectional geometry that is broadly defined by a vertical hook portion 132 transitioning to a lower horizontal hook portion 134. Hook portion 130 is further defined by vertical rear surface 136, horizontal lower surface 140, vertical hook portion front surface 138, horizontal hook portion front surface 144, and horizontal hook portion upper surface 142. Optionally, curved transition surfaces may be provided adjoining horizontal and vertical hook surfaces, for example, to facilitate insertion of the hook portion 130 of main body 100 into a frame member spline track during use, as described in greater detail below. For example, concave transition surface 137 may be provided adjoining hook rear surface 136 and main body lower surface 106, concave transition surface 139 may be provided adjoining hook vertical portion front surface 138 and main body lower surface 106, and curved/beveled transition surface 146 may be provided adjoining horizontal hook portion front surface 138 and hook horizontal lower surface 140. As best shown in FIGS. 3, 4, and 8, rear side 136 of hook portion 130 has a central recessed surface portion 135 for accommodating sliding vertical translation of reduced-thickness lower portion 204 (and, particularly, thickened lower end 240 in the exemplary implementation described and shown). In the exemplary implementation shown and described herein, recessed surface 135 is bounded by opposing inwardly-facing right and left side surfaces, 133*a* and 133*b*, respectively, and lower surface 106. However, as will be apparent to those skilled in the art, applicant contemplates an alternative implementation of the present invention in which the particular configuration of the thickened lower portion 240 may be reversed (i.e. such that the thickened portion may extend in a rearward direction, as opposed to the forwardly-extending thickened portion shown and described). In that case, the device 50 may incorporate a main body 100 having a rear surface 136 absent a recessed portion such as recessed area 135. Accordingly, the specific cross-sectional geometry of the thickened end portion 240 should not be interpreted as a limiting feature of the invention.

Main body 100 is particularly configured for engagement with slidable locking member 200. Slidable locking member 200 has a geometry that is broadly defined by a locking member main body 202, a reduced-thickness lower body portion 204, an upper end gripping portion which, in a preferred implementation, is in the form of a right gripping portion 206*a* and a left gripping portion 206*b* separated by a spline-retaining slot 208 extending through the upper gripping end and at least partially into the main body 202, and a thickened lower end 240.

The main body 202 of locking member 200 is further defined by a front surface 212, an opposite rear surface 213, and an inset, or recessed, main body lower portion front surface 210 defining a shoulder 214, a right end 222 and a left end 220. The spline-retaining slot 208 is defined by opposing vertical sidewalls 216, 218 adjoined by slot lower surface 217, which defines the slot depth. While not limiting, in a preferred implementation right gripping portion 206*a* may be further defined by an upper surface 226*a* and a partial perimeter edge 228 extending outward beyond main body 202 to define a lower surface 232 providing enhanced gripping during use of the device 50; particularly, when necessary to slide the locking member 200 upwardly vis-à-vis the main body 100 of the device 50. Likewise, left gripping portion 206*b* may be further defined by an upper surface 226*b* and a partial perimeter edge 230 extending outward beyond main body 202 to define a lower surface 234 providing enhanced gripping during use of the device 50.

At its lower end, reduced-thickness main body lower portion 204 has a thickened portion shown generally by reference numeral 240. In the exemplary implementation shown in the accompany drawing figures, the thickened portion is defined by an inwardly-tapered rear surface 241 and an inwardly-tapered front surface 243 adjoined at lower edge 245 of thickened lower end 240. The front surface 210 of inset, or recessed, thinned portion 204 of main body 202 of locking member 200 may terminate at a shoulder 242. Furthermore, shoulder 242 and thickened portion inwardly-tapered front surface 243 are adjoined at thickened portion horizontal edge 247.

As best shown with reference to cross-sectional FIGS. 3 and 8, the device 50 of the present invention enables vertical sliding translation of locking member 200 with respect to main body 100 while restricting lateral movement, or displacement, during such sliding movement of member 200 between the "unlocked" state (as shown in FIG. 3) and the "locked" state (as shown in FIG. 8).

Referring initially to FIG. 3, in the unlocked state, locking member 200 is in a raised position vis-à-vis main body 100. The main body 202 of the slidable locking member 200 has a thickness that is nominally less than the distance between opposing vertical sidewalls 128*a* and 129*a* defining the right side vertical recess in which the portion of main body 202 proximate right end 222 is seated (and likewise, nominally less than the distance between opposing vertical sidewalls 128*b* and 129*b* defining the opposing left side vertical recess in which the portion of main body 202 proximate left end 220 is seated). Furthermore, the width, or lateral distance, from opposite ends 220 and 222 of main body 202 of locking member 200 is nominally less than the corresponding distance between opposing right side recess sidewall 126*a* and left side recess sidewall 126*b*. In this manner, the main body 202 is restricted against any lateral displacement. In similar fashion, the thickness of lower portion 204 (of main body 202) of locking member 200 is nominally less than the width of slot 103 extending through low profile planar base 102. In this manner, the reduced-thickness lower portion 204 is likewise restricted against any lateral displacement. Together, these features effectively ensure that locking member 200 can only be displaced vertically.

Referring now particularly to FIG. 3, shoulder 242 functions as a stop limit during upward vertical displacement, or translation, of the locking member 200 via direct contact engagement between the shoulder and planar lower surface 106 of low profile planar base 102. As stated above, while shoulder 102 is shown extending in a forward direction in a preferred implementation the invention should not be interpreted as being limited by this particular configuration. Various alternative configurations of thickened lower end 240 may be employed without departing from the intended scope of the invention.

Referring now particularly to FIG. 8, in a similar manner, shoulder 214, adjoining front surface 210 of thinned lower body portion 204 and front surface 212 of main body 202 of locking member 200, functions as a stop limit during downward vertical displacement, or translation, of the locking member 200 via direct contact engagement between the shoulder 214 and planar upper surface 104 of low profile planar base 102.

Referring now to FIGS. 11A-11C, a series of steps for using the screen retention device will now be described. Initially, it should be noted that, for purposes of convenience and clarity, the drawings are not to scale and intentionally exaggerate the relative sizes of the device 50 vis-à-vis the depicted frame member 70 and spline track 79. Referring now to FIGS. 11A-11C, an example of a conventional extruded aluminum frame member, referenced generally by reference numeral 70, is shown in the form of a partial cross-sectional view particularly isolating a typical configuration of a spline track 70. A typical frame member, as shown, includes a spline-receiving track 79 defined by an exterior vertical sidewall 72, an opposite slightly inwardly-tapered interior sidewall 74, a generally horizontal bottom wall 76 (i.e. the bottom wall may be slightly tapered) adjoining the left and right sidewalls, an inwardly-extending lip 78, and a horizontal upper side 77.

Initially, as best shown in FIG. 11A, a peripheral portion of a mesh screen panel 60 is draped over the top 77, 78 of the frame member 70, such that the screen completely covers the spline track 79. With the screen 60 in place, the device 50, with locking member 200 in a retracted "unlocked" state (i.e. with the locking member preferably raised to its limit) is angularly rotated an adequate amount (a) from an initial vertical orientation (as shown) to facilitate insertion of hook portion 130 into the spline track receiving space 79. Although the device 50 is only shown slightly angularly rotated in the accompany figures, applicant notes that the device is preferably rotated approximately 45 degrees from vertical to facilitate insertion of the hook portion 130 into the spline track 79 through the spline track opening defined as the distance between the distal end of lip 78 and the junction between sidewall 72 and top side 77. Subsequently, the rotated device 50, with the locking member 200 retracted (i.e. in its "unlocked" position), is vertically lowered, or translated (as depicted by arrow $Y_1$) to insert the hook portion 130 into the spline track 79, with front surface 144 and bottom surface 140 of horizontal portion 134 preferably acting as the leading edge during the initial insertion step.

Referring now particularly to FIG. 11B, the device 50 is subsequently angularly rotated back (as represented by angular rotation arrow (β)) to its initial vertical orientation (as shown), such that the hook portion 130 and the corresponding inserted peripheral screen edge portion 60 are preferably compressed within the spline track 79. It is important to reiterate that the gap shown between the rear surface 136 of the hook portion 130 and the screen-covered interior surface of sidewall 72 has been shown for the purpose of convenience and clarity describing the steps of the insertion process. Preferably, there would actually be enough compression provided to retain the hook portion 130 (along with the underlying peripheral edge portion of the screen 60) within spline track 79 prior to the subsequent step (as shown in FIG. 11C) of biasing locking member 200 downwardly into its "locked" position. Accordingly, although not shown in the drawings, during the subsequent "locking" step the construction of the device is such that it allows for adequate deformation as the thickened portion 240 at the lower end of the locking member 200 is wedged between the screen-covered interior surface of the spline-receiving track and recessed surface portion 135 of rear surface 136 of hook portion 130.

Referring now particularly to FIG. 11C, following complete insertion of the hook portion 130 of main body 100 into the spline-receiving track 79, locking member 200 may be downwardly translated (as depicted by arrow $Y_2$) vis-à-vis main body 100 into its "locked" state. In particular, during the step of lowering the locking member 200 the thickened portion 240 (e.g. see FIG. 10) of reduced-thickness portion 204 (e.g., see FIG. 11B) is compressed between the mesh screen-covered interior surfaces of opposite sidewalls 72 and 74 of spline-receiving track 79 to effectively lock the device in place and thereby pin the corresponding mesh screen 60 against the interior surfaces of the aforementioned opposite sidewalls and, preferably, the shoulder 142 of hook portion 130 against frame member lip 78.

In this manner, the device 50 of the present invention provides an easy-to-use, effective means for enabling an individual to temporarily secure a panel of screening material at user-selected locations along its peripheral edge to a corresponding spline track of screen enclosure frame members defining a screen enclosure opening, thereby leaving both hands of the individual free to proceed with the insertion of spline into the corresponding spline track. Furthermore, as previously described hereinabove, an individual installing spline without the assistance of a second person can pull a length of spline taut and insert the spline (at a point along its length) into the spline-retaining slot 208 extending into the upper end portions 226*a*, 226*b* of main body portion 202 of locking member 200. By providing the spline-retaining slot 208 at the center of the upper end of the locking member, once an individual has selectively retained the length of spline into the spline-retaining slot the corresponding spline length runs just above the screen material draped over the corresponding frame member and in alignment with the underlying spline-receiving track. Accordingly, a single individual is left with both hands free to facilitate the subsequent step of permanently inserting spline into the spline-retaining track in order to install a tensioned panel of screen mesh material across a screen enclosure opening.

Since many modifications, variations, and changes in detail can be made to describe preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

For example, the present invention has been described herein in accordance with a particular implementation—that is, for use during the process of fixedly securing panels, or areas, of screen enclosure material across openings defined by a rigid framework assembly of framing members—for convenience. However, as one skilled in the art will readily recognize, the novel screen retention device of the present invention may be employed to temporarily retain a portion, or a partial area, of a unitary panel of material chosen from virtually countless materials, wherein lengths of spline material are conventionally used to fixedly secure peripheral portions of the material panel within corresponding channels, grooves, tracks, etc. of framing members of a framework structure, such that the panel is maintained taut within an opening defined, or formed, by a plurality of such framing members. Furthermore, although the inventive device is described herein with regard to an exemplary implementation that conventionally uses spline as the primary means for fixedly securing the periphery of material panel to the framing members, the invention is not intended to be so limiting. That is, the retention device of the present invention may be used for its intended purpose, regardless of the particular means (i.e. spline or non-spline means) ultimately employed to more-permanently attach a periphery of a material panel within a surrounding framing member channel, groove, track, etc. in association with myriad potential applications that utilize lengths of spline material as a primary means for fixedly securing structural components, such as individual framing members of a framework assembly, incorporating such channels, grooves, tracks, etc.

What is claimed is:

1. A device for selectively retaining a peripheral portion of a panel of screen mesh material within a spline track of a screen enclosure frame member, the device comprising:

(a) a laterally-extending main body having a unitary, one-piece molded plastic construction, the main body having a geometry at least partially defined by a central body portion having a planar upper surface and an opposite planar lower surface, together, defining a central body portion thickness therebetween, the planar upper surface of the central body portion bounded laterally by spaced-apart left and right end portions projecting upwardly therefrom, the left end portion having an interiorly-facing planar left vertical surface and the right end portion having an interiorly-facing planar right vertical surface opposing the left vertical surface, the opposing left and right end portion vertical surfaces having corresponding laterally-aligned, vertically-extending recesses defined therein, each of the vertically-extending recesses having a recess width, the central body portion having a lateral slot extending completely through the central body portion thickness, the lateral slot having a slot width and a slot length, the slot length extending laterally between the left and right end portion vertically-extending recesses, and the central body portion planar lower surface having a laterally-extending hook portion depending downwardly therefrom; and (b) a laterally-extending slidable locking member having a unitary, one-piece molded plastic construction, the laterally-extending slidable locking member having a geometry at least partially defined by a slidable locking member upper portion extending laterally between slidable locking member upper portion left and right ends, the slidable locking member upper portion having opposite front and rear planar surfaces defining a slidable locking member upper portion thickness therebetween, the slidable locking member upper portion transitioning, at a slidable locking member shoulder, to a slidable locking member lower portion extending laterally between slidable locking member lower portion left and right ends, the slidable locking member lower portion having opposite front and rear planar surfaces, the slidable locking member lower portion rear planar surface contiguous with the slidable locking member upper portion rear planar surface, the slidable locking member lower portion front surface inset from the slidable locking member upper portion front surface, at the slidable locking member shoulder, to define a slidable locking member lower portion reduced thickness, vis-à-vis the slidable locking member upper portion thickness, a lower end of the slidable locking member lower portion defining a laterally-extending thickened lower edge feature.

2. The device as recited in claim 1, wherein the slidable locking member upper portion further comprises a hand-gripping upper edge portion.

3. The device as recited in claim 2, wherein the hand-gripping upper edge portion has a spline-retaining slot extending therethrough, the spline-retaining slot sized, shaped, and otherwise configured for frictionally securing a length of spline inserted therein.

4. The device as recited in claim 3, wherein the spline-retaining slot further extends at least partially into the slidable locking member upper portion.

5. The device as recited in claim 1, wherein the left and right ends of the slidable locking member upper portion are slidably received through respective ones of the laterally-aligned, vertically-extending recesses defined in the respective opposing left and right end portion vertical surfaces of the main body, and wherein the recess width of the vertically-extending recesses is nominally greater than the corresponding thickness of the slidable locking member upper portion, thereby restricting lateral displacement of the slidable locking member with respect to the main body.

6. The device as recited in claim 5, wherein the slidable locking member lower portion is slidably received through the laterally-extending slot in the central body portion of the main body, the laterally-extending slot width nominally greater than the corresponding thickness of the slidable locking member lower portion, and the laterally-extending slot length nominally greater than a corresponding lateral length of the slidable locking member lower portion.

7. The device as recited in claim 1, wherein the slidable locking member lower portion is slidably received through the laterally-extending slot in the central body portion of the main body, the main body laterally-extending slot having a slot width nominally greater than the corresponding thickness of the slidable locking member lower portion, and the main body laterally-extending slot having a slot length nominally greater than a corresponding lateral length of the slidable locking member lower portion.

8. The device as recited in claim 1, wherein the laterally-extending thickened lower edge feature at the lower end of the slidable locking member lower portion further comprises a shoulder, the shoulder defining a stop limit during upward translation of the locking member with respect to the main body.

9. The device as recited in claim 1, wherein the slidable locking member shoulder further comprises a downwardly-facing planar surface defining a stop limit during downward translation of the slidable locking member with respect to the main body.

10. The device as recited in claim 9, wherein the downwardly-facing planar surface of the slidable locking member shoulder is positioned for direct contact engagement with the upper surface of the central body portion of the main body during downward translation of the slidable locking member with respect to the main body during a locking function of the device within the spline track to temporarily retain the peripheral portion of the panel of screen mesh material therein.

* * * * *